US007107733B1

(12) United States Patent
Rueckert

(10) Patent No.: US 7,107,733 B1
(45) Date of Patent: Sep. 19, 2006

(54) DEPLOYABLE STRUCTURE WITH MODULAR CONFIGURATION CONSISTING OF AT LEAST ONE COLLAPSIBLE MODULE

(76) Inventor: Gerhard Rueckert, Am Kroegel 3, Berlin (DE) 10179

( * ) Notice: Subject to any disclaimer, the term of this patent is extended or adjusted under 35 U.S.C. 154(b) by 67 days.

(21) Appl. No.: 10/069,705

(22) PCT Filed: Aug. 9, 2000

(86) PCT No.: PCT/EP00/07728

§ 371 (c)(1),
(2), (4) Date: Feb. 25, 2002

(87) PCT Pub. No.: WO01/14654

PCT Pub. Date: Mar. 1, 2001

(30) Foreign Application Priority Data

Aug. 25, 1999 (DE) ..... 199 40 169

(51) Int. Cl.
*E04H 12/18* (2006.01)

(52) U.S. Cl. ..... 52/646; 52/645; 135/25.2; 135/122; 135/123; 135/143; 135/145; 135/147; 135/908

(58) Field of Classification Search ..... 52/646, 52/653.1, 653.2, 655.1, 655, 109; 40/610; 135/25.2, 122, 123, 143, 145, 147, 908; 248/165, 166

See application file for complete search history.

(56) References Cited

U.S. PATENT DOCUMENTS 4,276,726 A * 7/1981 Derus ..... 52/109
4,471,548 A * 9/1984 Goudie ..... 52/646
4,480,415 A 11/1984 Truss
4,527,362 A * 7/1985 Tobey et al. ..... 52/71
4,580,375 A 4/1986 Nodskov et al.
4,599,832 A * 7/1986 Benton et al. ..... 52/118
4,658,560 A * 4/1987 Beaulieu ..... 52/646
4,663,899 A * 5/1987 Nodskov et al. ..... 52/109
4,667,451 A * 5/1987 Onoda ..... 52/646
4,745,725 A * 5/1988 Onoda ..... 52/646
4,791,761 A * 12/1988 Goudie ..... 52/109
4,947,884 A 8/1990 Lynch
4,970,841 A * 11/1990 Zeigler ..... 52/646
5,014,484 A * 5/1991 Tanozawa et al. ..... 52/646
5,230,196 A 7/1993 Zeigler
5,327,700 A * 7/1994 Sorenson et al. ..... 52/109

(Continued)

FOREIGN PATENT DOCUMENTS

DE 3222475 1/1983

(Continued)

*Primary Examiner*—Carl D Friedman
*Assistant Examiner*—Yvonne M. Horton
(74) *Attorney, Agent, or Firm*—W. F. Fasse; W. G. Fasse

(57) ABSTRACT

A variable support structure with modular construction includes at least one support structure module, which is bounded by joints (114, 115, 126, 121) of a first joint set that lie in a first surface, and by joints (101, 102, 113, 108) of a second joint set that lie in a second surface, and with at least one joint (109) of a third joint set that lies outside of the first surface. At least some of the joints of the first and second joint sets have a fixable position relative to one another, especially being connectable with one another, by a guide mechanism. The at least one joint (109) of the third joint set is connected with at least two joints (114, 115, 113, 121) of the first and/or second joint set by a connecting element (39, 41, 43, 45) that transmits essentially only tension forces.

17 Claims, 8 Drawing Sheets

U.S. PATENT DOCUMENTS 5,444,946 A * 8/1995 Zeigler ..... 52/86

FOREIGN PATENT DOCUMENTS

| | | |
|---|---|---|
| DE | 259651 | 8/1988 |
| DE | 19651444 | 6/1998 |
| JP | 06087497 | 3/1994 |
| WO | WO93/13284 | 7/1993 |
| WO | WO94/23162 | 10/1994 |

* cited by examiner

DEPLOYABLE STRUCTURE WITH MODULAR CONFIGURATION CONSISTING OF AT LEAST ONE COLLAPSIBLE MODULE

FIELD OF THE INVENTION

The invention relates to a variable or deployable support structure with a modular construction or configuration, consisting of at least one collapsible support structure cell or module.

BACKGROUND INFORMATION

A support structure of such type is, for example, known from the U.S. Pat. No. 4,580,375. Therein, the at least one joint of the third joint set is connected with the four corner joints of the first joint set by means of four rods, which are articulately connected with one another in the joint of the third joint set. In a corresponding manner, the corner joints of the second joint set are connected by four rods with a further joint of the third joint set. The rods that lead from the one and the further joint of the third joint set to neighboring corner joints of the first and second joint set are crossed-over and pivotally connected with one another, and respectively form an inner scissors arrangement arranged within the support structure module. The neighboring corner joints of the first and second joint set are connected, i.e. fixed in their position relative to each other, with neighboring corner joints of the second or first joint set of a neighboring corner, by a guide mechanism in the form of rods that are pair-wise crossed-over and pivotally connected with one another while forming outer scissors arrangements. The formation or embodiment of the inner scissors arrangements is constructively disadvantageous, requires an increased production technology effort, and limits the functionality of the support structure module as well as the forms or configurations that can be formed therewith.

The U.S. Pat. No. 5,230,196 shows a support structure with at least one support structure module, wherein joints of a first joint set are connected with joints of a second joint set via so-called outer rod scissors. The mutually neighboring joints of the first joint set are respectively connected with one another by a steel cable running along the edge of the support structure module. In order to prevent a twisting or tangling of the steel cables into one another, especially in the collapsed condition of the support structure, the steel cables running along the edge of the support structure module are connected approximately at the middle thereof by cable holding means with respectively one rod near the articulated joint point of the outer rod scissors. The mutually diagonally opposed joints of the second joint set of the support structure module are connected with one another via steel cables, whereby no coupling or junction of the steel cables is achieved in the crossing point, and thus, the crossing point does not form a joint of the support structure module.

The DE 196 51 444 A1 shows a structural component made of a truss framework support system with at least one centrally arranged glass element that encloses a space, in connection with which there are arranged tension elements that are connected with the glass element on opposite sides, whereby the glass element is set under compression, and therewith the typically unutilized support potential of the glass structural material is utilized.

The DE 32 22 475 A1 shows an extendable mast construction with an open frame, which comprises three main support struts or spars, which lie parallel to each other and define three planes when the mast is extended. The struts or spars are formed between two triangle frame elements respectively by two rods, which are connected articulately with one another at their connection location, and which are articulately connected at their other end with a point of a triangle frame element. The pivot joints are arranged in such a manner so that each rod pair pivots in one of the three planes. Thereby, the rods do not protrude into the inner space of the mast construction. This similarly prevents a pivoting of the rods when bending loads of the mast construction arise. Tension wires are arranged between the vertex points of neighboring triangle frame elements, which vertex points are not oriented to each other. These tension wires run in the planes defined by the main support struts or spars. The cables are not connected with one another at their intersection points and thus do not form joints of the mast construction at their crossing point.

The DD 259,651 A1 shows a collapsible or disassembleable, light-weight, spatial framework or support structure, which consists of two pyramids, of which the peaks are arranged to be slidable in a contrary fashion on a guide piece. The side edges lying between the base surface formed by joints of a first or second joint set and the peak formed by a joint of the third joint set, of each respective pyramid, are compression elements. Tension elements are arranged both between the corner points of the base surface of each respective pyramid as well as between the mutually opposed corner points of the base surfaces of both pyramids.

SUMMARY OF THE INVENTION

The problem underlying the invention is to provide a support structure with at least one support structure cell or module, especially a variable or convertible support structure with a cellular or modular construction consisting of at least one support structure cell or module, which overcomes the disadvantages of the prior art. Especially, the support structure shall be constructively and functionally improved as well as being simplified with respect to the fabrication technology thereof, and simultaneously shall make a great variety of configurations possible.

The above mentioned problem has been solved according to the invention in a deployable structure with a modular configuration consisting of at least one collapsible module, which is bounded by joints of a first joint set, which are corner joints of the module and lie in a first surface, and by joints of a second joint set, which are corner joints of the module and lie in a second surface, and with at least one joint of a third joint set, which lies outside of the first surface, whereby at least some of the joints of the first and second joint sets respectively have a fixable position relative to one another, especially connectable with one another, by a guide mechanism, characterized in that, one of the joints of the third joint set is connected with at least two of the joints selected from at least one of the first and second joint sets by a tension-only connecting element that is adapted and able to transmit only tension forces, and said one of the joints of the third joint set is arranged below a lowermost joint among the joints of the first joint set with which said one of the joints of the third joint set is connected, and characterized in that forces arising upon loading of the structure by at least one of a useful working load and a self-weight load are transmittable as tension forces away from said one of the joints of the third joint set to the joints of at least one of the first and second joint sets via the tension-only connecting element that is adapted and able to transmit only tension forces.

The described invention finds application for mobile as well as locationally fixed, but temporary support structures, as well as for the embodiment of permanent support structures in a segmental manner of construction. The effort for transport, storage, erection, and disassembly or take-down is minimal, while the freedom in embodying the configuration is great. The structural static characteristics are especially advantageous. Applications for pavilions, tents, dug-out shelters, emergency shelters, erecting and sheathing systems, come into consideration just as applications in the fields of aeronautic and astronautic technology, for example for antennas and masts, in the construction of pieces of furniture or for objects in the field of play and leisure-time activities, such as kites for example. Locationally fixed but temporary applications are, for example, to roof-over sport and recreational facilities, public plazas, terraces, or atrium or interior spaces. Permanent support structures can be very rationally erected by the connection of plural individual stressed or expanded substructures, which in turn again may consist of plural support structure cells or modules, for example by being suspended into place by means of a crane.

The at least one joint of the third joint set is connected with at least two joints of the first and/or second joint set, preferably with three, four or all joints of the first and/or second joint set of the support structure cell or module, by a connecting element that transmits essentially only tension forces. These connecting elements conduct the tension forces that arise upon loading of the support structure by a useable payload and/or the self-weight load or dead load, from the joint of the third joint set to the joints of the first and/or second joint set. Preferably, the joint of the third joint set is equidistant to the ones connected to it or to all joints of the first and/or second joint set. The corner joints of the first joint set form a first, for example upper, bounding surface of the support structure and are spaced, generally in the vertical direction, from the associated corner joints of the second joint set which form a second, for example lower, bounding surface of the support structure. The connecting elements which essentially transmit tension forces are fixed, especially articulately joined, at the respective joints, and are, for example, formed of respectively two parallel extending wires or cables of steel or another suitable material. The at least one joint of the third joint set lies below the lowermost corner joint of the first joint set with which it is connected.

A joint of the third joint set is connected with at least one, preferably with three, four or all of the joints of the second joint set, by a connecting element that transmits compression and tension forces. Preferably, this joint of the third joint set is equidistant to the one connected to it or to all of the joints of the second joint set. The forces arising upon loading of the support structure are transmitted away by this connecting element, essentially as compression forces, to the joints of the second joint set, of which generally a portion rest on a support of the support structure. The connecting elements that transmit tension and compression forces are articulately joined to the respective joints and are especially formed by rods of aluminum or some other suitable material. Basically it pertains that the utilized materials comprise the smallest possible mass with a sufficient load capacity. The joints of the third joint set are generally arranged within or on the edge of the cell or module space spanned by the corner joints, preferably in any event within a surface bounded by the corner joints.

The respective joints of the first and second joint set may either be connected with a common joint of the third joint set, or the at least two corner joints of the first and/or second joint set are connected with a first joint of the third joint set and the at least one corner joint of the second joint set is connected with a second joint of the third joint set, whereby preferably the first joint of the third joint set is connected with the second joint of the third joint set by a connecting element that transmits tension and compression forces. Thereby, the forces arising in the interior of a support structure cell or module are transmitted away essentially or exclusively as compression forces onto the corner joints of the second joint set and as tension forces onto the joints of the first joint set.

In a particular embodiment of the invention, the surfaces formed by the joints of the first and second joint set respectively form a plane. Thereby, especially in an extended or deployed condition of the support structure cell or module, all of the joints of the second joint set and the joint of the third joint set, which is connected with at least two joints of the first and/or the second joint set, can lie in one plane, and/or all joints of the first joint set and the joint of the third joint set, which is connected with at least one joint of the second joint set, can lie in one plane. Thereby, there result a constructively and functionally advantageous, planar, first and/or second, for example upper and lower, bounding surface of the support structure cell or module, or respectively of the support structure. In a corresponding manner, however, these surfaces may also form, for example, at least a portion of a spherical shell or an outer shell surface of a circular cylinder. Planar, one- and two-sided curved support structure cells or modules are combinable to form a support structure with a complex configuration.

A joint of the first joint set of a corner especially arranged at the outer circumference of the support structure is connectable with a joint of the second joint set of a neighboring corner especially arranged on the outer circumference of the support structure, and a joint of the second joint set of the corner is connectable with a joint of the first joint set of the neighboring corner, by elements that are crossed-over and pivotally connected with one another and that transmit tension and compression forces. The outer scissors arrangements of the support structure cell or module, or respectively of the support structure, that are formed thereby, in turn form a guide mechanism, which fixes the position relative to one another of the joints that are connected with one another, and, together with the connections to the joints of the third joint set, form a triangular trussing of the support structure cell or module that is very advantageous in view of structural statics. Alternative guide mechanisms, which guide the corresponding joints in associated control or guide paths, are possible.

Preferably, the connecting elements that transmit tension and compression forces and that lead to the supports of the support structure have a greater load capacity, especially a greater diameter, than the remaining connecting elements of the guide mechanism, because greater forces must be transmitted over these connecting elements. Insofar as the surface spanned by the joints shall be a plane, the connecting elements that are crossed-over and pivotally connected with one another are connected with one another centrally, i.e. in the middle with respect to their lengthwise direction. Insofar as the surface spanned by the joints shall comprise a curvature, the connecting elements that are crossed-over and pivotally connected with one another are connected with one another eccentrically, i.e. away from their middle in the length direction.

The expansion or extension of the support structure is variable, particularly the support structure or the support structure cell or module is collapsible and expandable. The expansion of the support structure is adjustable by an operating arrangement, which comprises expansion means and retraction means, especially an expansion cable and a retraction cable, which are guided over deflecting means in the respective joints, and are preferably fixably operable on a common joint. For example, a motor driven winch can be arranged on the common joint, whereby this winch operates the expansion and retraction of the support structure. The expansion and retraction of the support structure is carried out in a manner free of self-tension, in other words in every desired condition during the expansion and retraction, preferably only the loads caused by the self-weight load or dead load and, if applicable, a useful payload, arise in the support structure. Moreover, the support structure is preferably subjectable to a pre-stressing by means of the operating arrangement, so that it takes up a prescribable form in a loaded condition. This pre-stressing can be achieved, for example, by clamping of the expansion cable with simultaneously application of a tension force to the retraction cable, and then fixing or clamping of the retraction cable.

The expansion cable is guided in the respective joints over deflection means, for example deflection rollers or deflection saddles, with preferably two different deflection radii. There, where the expansion cable is guided along a connecting element of a scissors arrangement, it extends between the two connecting elements forming the scissors arrangement. Due to the differing deflection radii of the deflecting means, the expansion cable is guided past the scissors joints.

The connecting elements transmitting the tension and compression forces are connected at their ends with the respective joints by pivot joints that are arranged horizontally and perpendicularly to the longitudinal axes of the connecting elements. With the possible eccentric arrangement of the scissors joints, the support structure is embodiable, for example as a spherical shell element, without introducing self-stresses in the course of the expansion and retraction. The connecting elements of the scissors pairs, which are thereby tilted out of the vertical plane, as well as the connecting elements connected with the joints of the second and third joint set, generally require, at their joint connections located at their beginning and end, a further rotational degree of freedom, which may be provided, for example, by two successive pivot joints with pivot axes that are orthogonal relative to one another.

The joints of the first and/or second joint set, preferably under inclusion of the joints of the third joint set, are connectable with a membrane in such a manner so that an at least partially closed outer surface of the first or second surface is thereby formed. If both the joints of the upper as well as of the lower joint network are connected with a continuous membrane, then there arises a pillow or cushion structure reinforced with an internal skeleton. Thereby, the operating arrangement for varying the expansion of the support structure may be embodied by the pneumatics of the pillow or cushion, alternatively or as a supplement to the expansion cable and the retraction cable. In the collapsed condition, the membrane is preferably folded together in the interior of the support structure.

Especially the joints of the first joint set and the at least one joint of the third joint set, which are connected with the joints of the second joint set by connecting elements that transmit tension and compression forces, can be connected with at least one preferably triangular shaped panel element in such a manner so that an at least partially closed outer surface of the first surface is thereby formed. The loading of the support structure caused by the mass of the panel elements is compensatable by an over-heightening in the unloaded condition. The panel elements are preferably to be arranged in such a manner so that at least a portion thereof connect the joints of the third joint set of neighboring support structure cells or modules with one another. Due to the composite effect of support structure and panel elements, the support capacity of the support structure is further increased, especially the panel elements function as further connecting elements that transmit tension and compression forces.

Further advantages, features and details of the invention follow from the dependent claims as well as the following description, in which several example embodiments are described in detail with reference to the drawings. Thereby, the features mentioned in the claims and in the description can be essential to the invention, respectively individually by themselves, or in any desired combination.

DETAILED DESCRIPTION OF THE INVENTION

Figure 1:
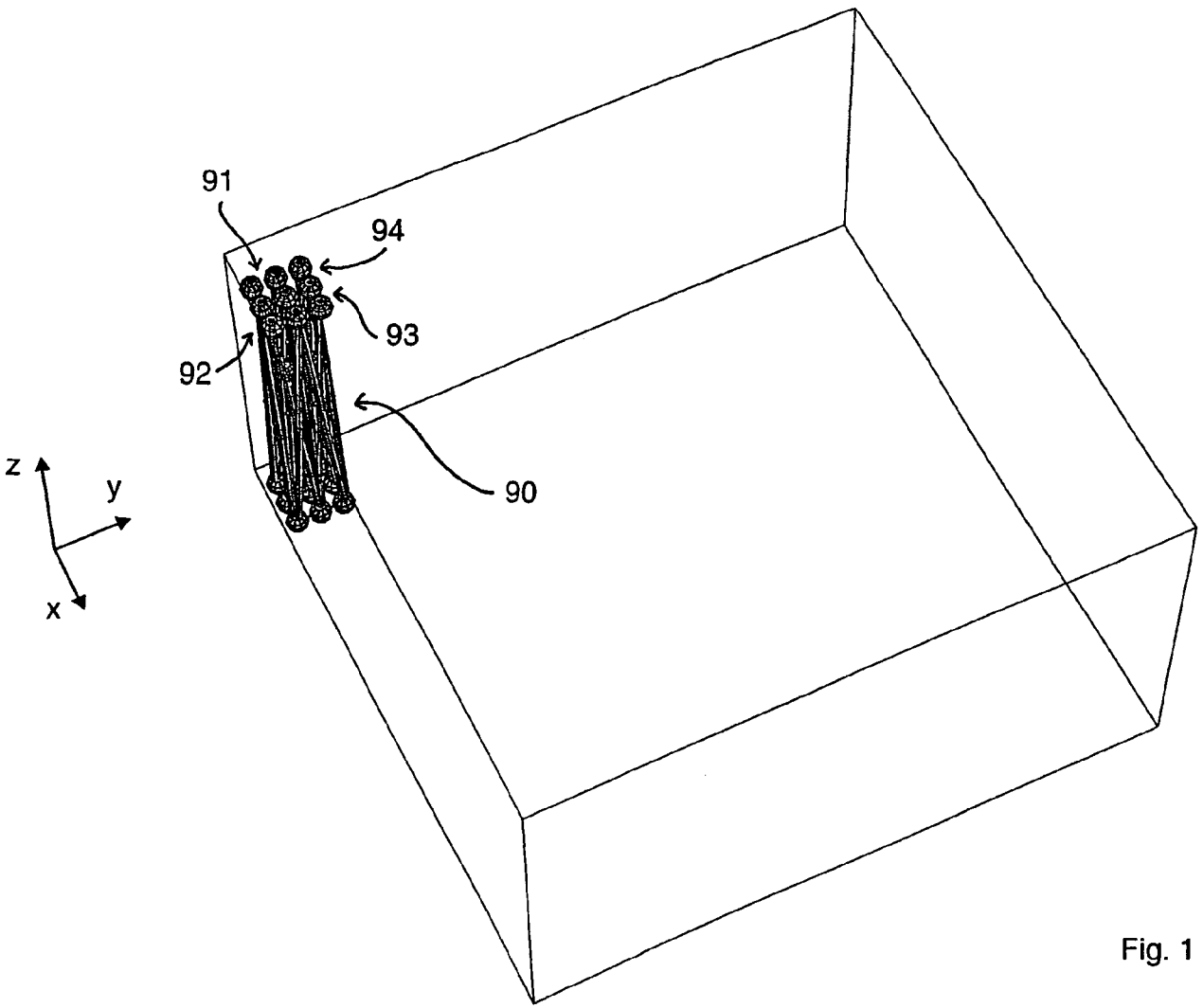
FIG. 1 shows a support structure consisting of 2×2 support structure cells or modules in the collapsed condition.

The FIG. 1 shows a support structure 90 consisting of 2×2 support structure cells or modules 91, 92, 93, 94 in the collapsed condition, in which the support structure 90 is compact, easy to transport and to store. In this condition, the support structure 90 has the largest expansion in the vertical Z-direction. The expansion in the horizontal X- and Y-directions is minimized. The upper joints 114 to 121 and 126 (FIG. 3) of the first joint set lie in a plane, just as the lower joints 101 to 108 and 113 (FIG. 3) of the second joint set. In the collapsed condition, the joints 109 to 112 and 122 to 125 (FIG. 3) of the third joint set are arranged in the vertical direction between the joints of the first and second joint set and in the center of their respective support structure cell or module. The support structure cell or module 91 in the example embodiment is square in the top plan view, but it could just as well be triangular or polygonal. The support structure can be formed by any desired, also three-dimensional, arrangement of n×m (n, m natural numbers) support structure cells or modules.

Figure 2:
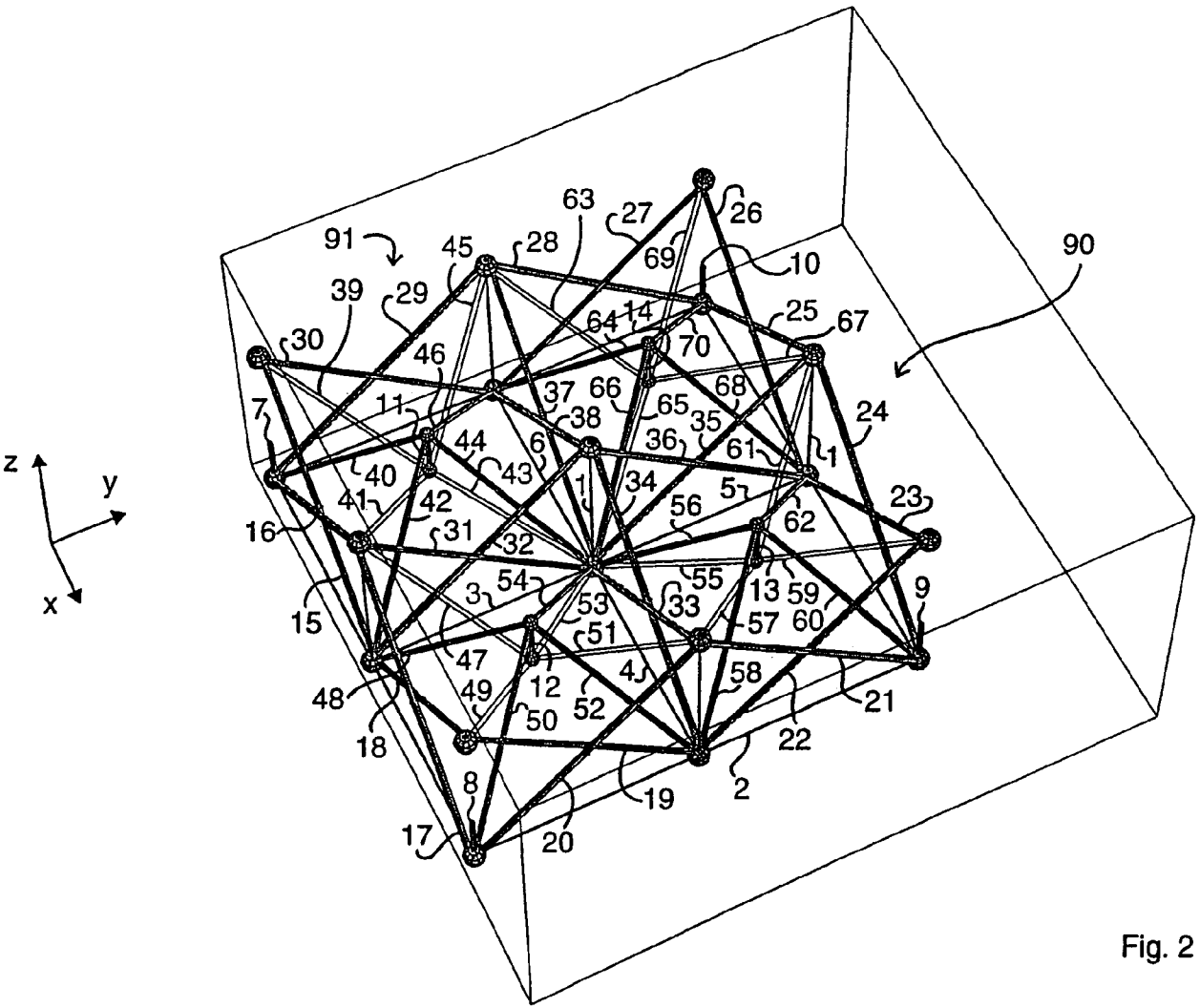
FIG. 2 shows the support structure of the FIG. 1 in a partially expanded condition.

The FIG. 2 shows the support structure 90 of the FIG. 1 in a partially expanded condition. The spacing of the joints 114 to 121 and 126 (FIG. 3) of the first joint set, and of the joints 101 to 108 and 113 (FIG. 3) of the second joint set has been reduced in the Z-direction, and has been enlarged in the X- and Y-direction. In the following, as an example, the construction and the kinematics of a support structure module 91 are described. The joints 114, 115, 126 and 121 form the four corner joints of the first joint set of a support structure module 91 that is quadrangular in the top plan view. In registration or alignment herewith, the joints 101, 102, 113 and 108 form the four corner joints of the second joint set. One joint 109 of the third joint set is connected with the joints 114, 115, 113, 121 of the first and second joint set respectively by two steel cables 39, 41, 43, 45 that extend parallel to one another and that transmit essentially only tension stresses. A further joint 122 of the third joint set, which is equally spaced from the joints 101, 102, 113, 108 of the second joint set, is connected with these by a respective aluminum rod 40, 42, 44, 46 that transmits tension and compression forces. The two joints 109, 122 of the third joint set are connected with one another by an aluminum rod 11 that transmits tension and compression forces and that is oriented vertically in the Z-direction in the illustrated example embodiment. In the illustrated condition, the vertical aluminum rod 11 is located in the center of the space spanned by the support structure module 91.

The support structure modules 92, 93, 94 are constructed in a corresponding manner. Neighboring support structure modules 91, 92, 93, 94 comprise common corner joints. In the illustrated 2×2 arrangement of the support structure modules 91 to 94, the central joints 113, 126 are common joints of all of the support structure modules 91 to 94.

In the illustrated embodiment, all joints of the first and second joint set are variably fixed or determined in their position relative to one another in a positively enforced or constrained manner by a guide mechanism in the form of inner and outer scissors arrangements. The inner and outer scissors arrangements serve to transmit away or to transmit further the forces acting on the joints. The corner joint 114 of the first joint set is connected with the corner joint 102 of the second joint set of a neighboring corner, and the corner joint 101 of the second joint set is connected with the corner joint 115 of the first joint set of the neighboring corner, by aluminum rods 15 or 16 respectively, which are crossed-over and pivotally connected with one another, and which transmit tension and compression forces. The further aluminum rods 17, 18; 19, 20; 21, 22; 23, 24; 25, 26; 27, 28; 29, 30 pair-wise form outer scissors arrangements of the support structure 90 in a corresponding manner. By means of these scissors arrangements, the position of the joints of the first and second joint set relative to one another is variably fixed or determined during the varying of the expansion of the support structure 90.

Figure 11:
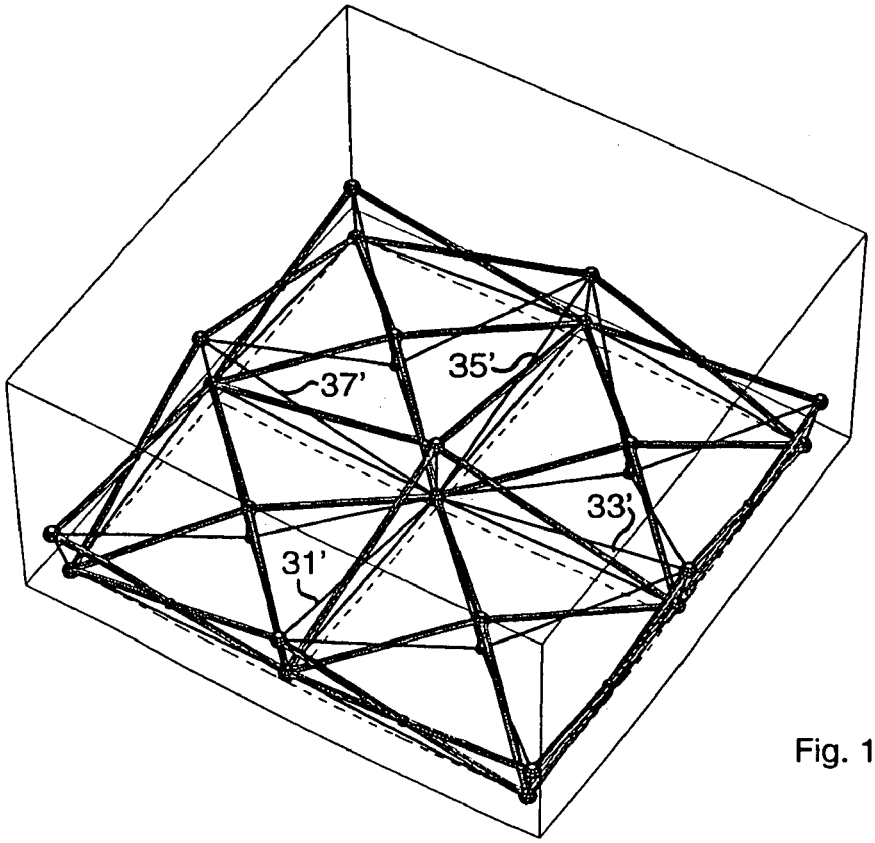
FIG. 11 shows an alternative embodiment.

Moreover, the support structure 90 still further comprises the so-called inner scissors arrangements, which are similarly formed by aluminum rod pairs 31, 32; 33, 34; 35, 36; 37, 38 that are crossed-over and pivotally connected with one another. The scissors joints are respectively arranged in the middle of the rods in the illustrated embodiment. With an eccentric arrangement of the scissors joints in the joints 127 to 138, the support structure is embodiable as a cylindrical or spherical shell while maintaining the general topology and without introducing self-stresses in the course of the expansion or retraction. The rods of the scissors pairs, which are thereby tilted out of the vertical plane, as well as the connecting elements that are connected with the joints of the second and third joint sets generally require a further rotational degree of freedom at the joint connections at their beginning and end. This further rotational degree of freedom is providable, for example, by two successive pivot joints with rotation axes that are orthogonal to one another. In the realization of a spherical shell, the inner scissors joints on the joints 135 to 138 are preferably omitted, whereby in this case, the connecting elements 31, 33, 35, 37 are embodiable as connecting elements 31', 33', 35', 37' that transmit essentially only tension stresses, for example cables (FIG. 11).

The connecting elements 3 to 6 that transmit essentially only tension stresses are embodied as steel cables and exert tension forces on the joints 102, 104, 106, 108, 113 of the second joint set, which are connected thereto. Connecting elements in the form of aluminum rods are arranged as so-called corner stands 7, 8, 9, 10 in the corners of the support structure 90 on the corner joints 101, 103, 105, 107 of the second joint set, whereby these connecting elements transmit essentially compression forces. In the stressed or spread-out condition of the support structure 90, a contacting abutment exists between the corner stands 7, 8, 9, 10 and the associated corner joints 114, 116, 118, 120 of the first joint set.

The rods of the scissors arrangements and the connecting elements leading to the joints 109 to 112 and 122 to 125 of the third joint set, exclusive of the rods 11, 12, 13, 14, are connected at their ends with respectively one joint of the first, second or third joint sets, by respectively one pivot joint with a pivot axis that extends horizontally and perpendicularly relative to the longitudinal axis. The two rods of one scissors arrangement are additionally connected at their crossing point with the joints 127 to 138, by respectively one pivot joint with a pivot axis that extends horizontally and perpendicularly to the longitudinal axis. The connecting elements 3 to 6, which transmit essentially only tension forces, are connected at their ends with joints of the second joint set by respectively one pivot joint with a pivot axis that extends horizontally and perpendicularly to the longitudinal axis.

Figure 6:
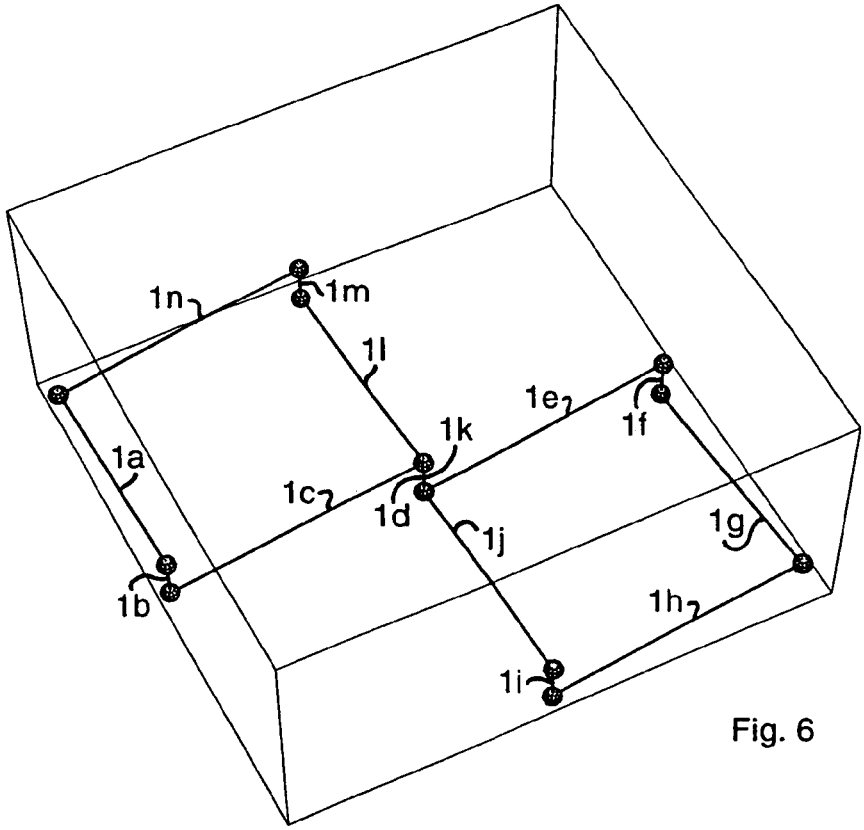
FIG. 6 shows the extending path of the expansion cable.
Figure 7:
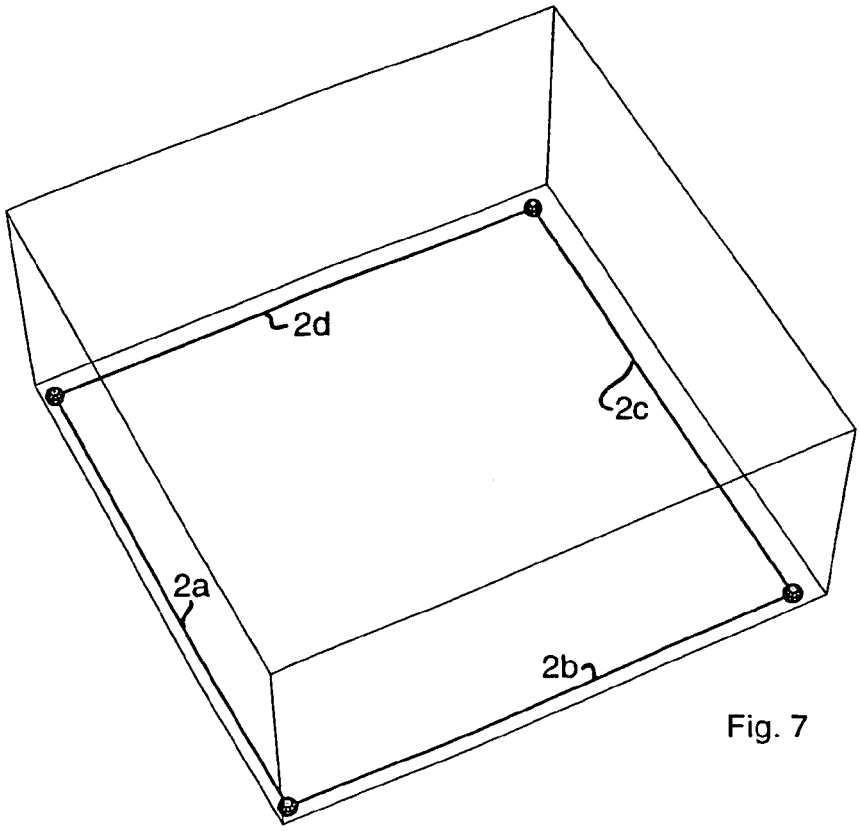
FIG. 7 shows the extending path of the retraction cable.

The expansion cable 1 and retraction cable 2 is attached on a joint and extends through the support structure 90 over deflection rollers and/or deflection saddles integrated in the joints, to an exit point out of the support structure 90 which preferably comprises a fixing clamp. In the illustrated example embodiment, the expansion cable 1 is attached on the joint 101 and runs with its segments 1*a* to in over the joints 115-102-126-113-119-106-118-104-117-113-126-108 and 121 back to the joint 101 and is there guided out of the support structure 90, as shown in the FIG. 6. The retraction cable 2 is similarly attached on the joint 101, and runs with its segments 2*a* to 2*d* over the joints 103–105 and 107 back to the joint 101 and is there similarly guided out of the support structure 90, as shown in the FIG. 7.

For the adjustable variation of the support structure 90, in the opened condition of the clamps, the portion of the expansion cable 1 or respectively the retraction cable 2 located in the support structure 90 is varied by means of a winch respectively connected with the loose end of the cables. With a shortening of the expansion cable 1, and with a simultaneous lengthening of the retraction cable 2, the support structure is extended or expanded. Insofar as the cables 39, 41, . . . , 69 connected with the joints 109 to 112 of the third joint set are installed in a shortened state with respect to the geometry in the opened stressed condition, they are stretched or elongated by the expansion of the support structure 90. This achieves a pre-stressing of the connecting elements connected with the joints 109 to 112 and 122 to 125 of the third joint set, which is advantageous with respect to the structural statics. In a corresponding manner, with a shortening of the retraction cable 2 and simultaneous lengthening of the expansion cable 1, the structure is collapsed or retracted. If the retraction cable 2 is set under tensile stress or retracted in the expanded condition, and with a clamped condition of the expansion cable 1, thereby the support structure 90 is pre-stressed, especially to be convexly over-heightened in the illustrated example embodiment. Thereby, the support structure 90 can be adjusted or re-adjusted corresponding to the useable payload that is to be taken up or respectively corresponding to the allowable deformations, already during the expansion or during the later use thereof.

Figure 3:
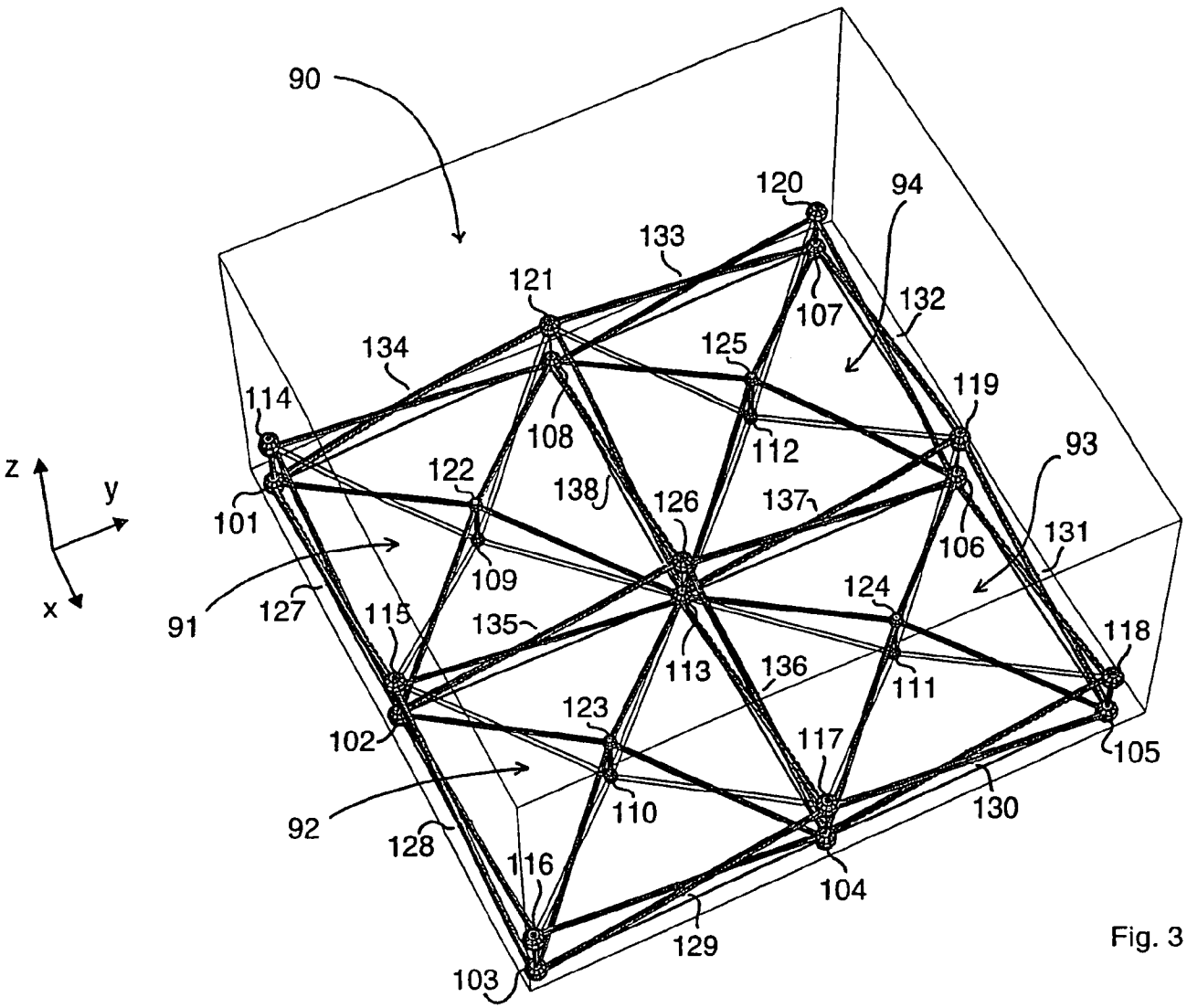
FIG. 3 shows the support structure in the completely expanded condition.

The FIG. 3 shows the support structure 90 in the fully expanded condition. The joint 101 is thereby connected with a rigid or fixed support (not shown) of the support structure 90, while the joints 103, 105, 107 rest on slide bearings (not shown). In the completely expanded condition, all joints 114 to 121 and 126 of the first joint set, as well as the joints 122 to 125 of the third joint set connected with the joints of the second joint set lie in a first upper plane. Correspondingly, all joints 101 to 108 and 113 of the second joint set and the joints 109 to 112 of the third joint set connected with the joints of the first joint set lie in a second plane, which extends parallel to the first plane and is arranged below the first plane.

Figure 4:
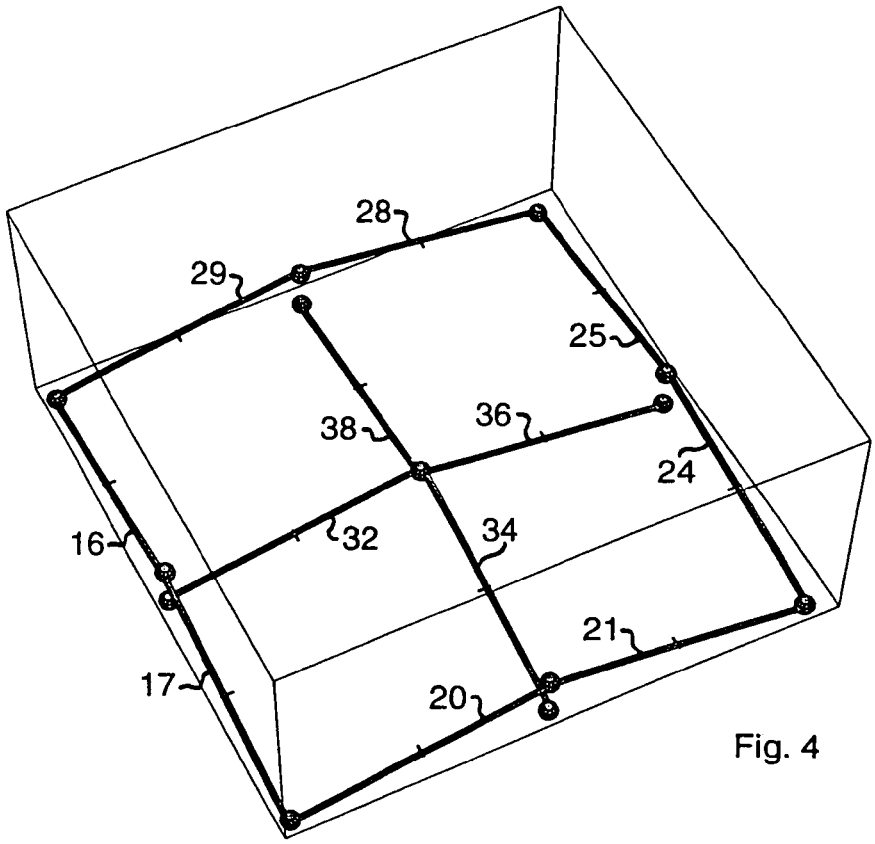
FIG. 4 shows the connecting elements of the guide mechanism leading to the supports.

The FIG. 4 shows the connecting elements 16, 17, 20, 21, 24, 25, 28, 29, 32, 34, 36, 38 of the outer and inner scissors arrangements leading to the supports. These have a higher load capacity, especially a larger cross-section, than the connecting elements crossed-over and pivotally connected therewith.

Figure 5:
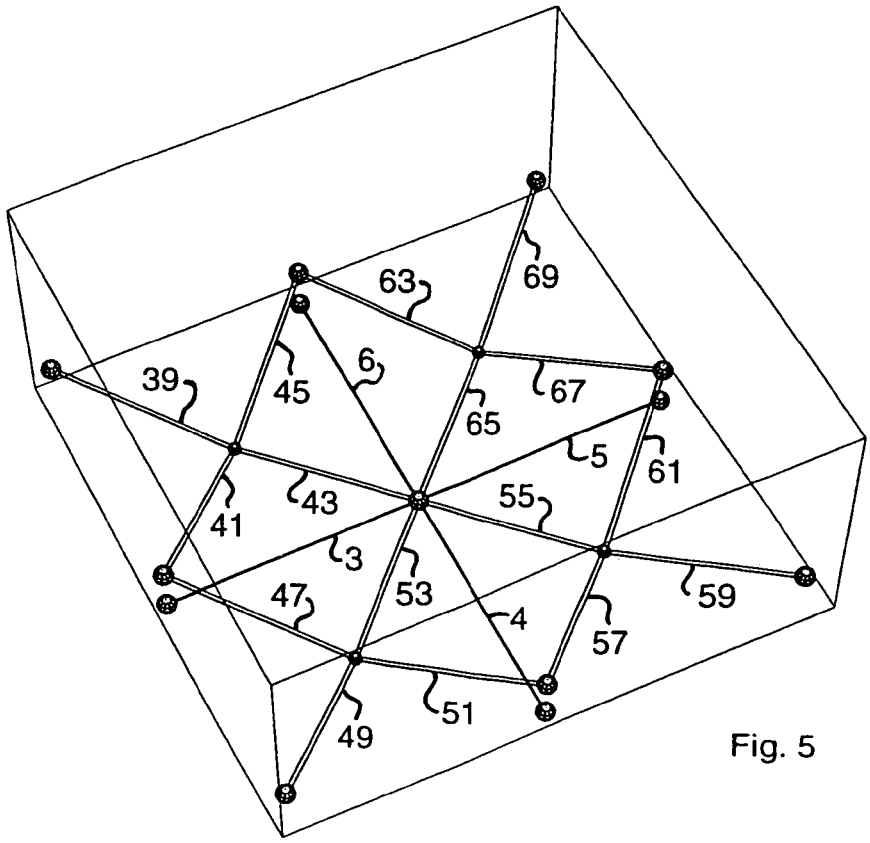
FIG. 5 shows the connecting elements that transmit essentially only tension forces.

The FIG. 5 shows the connecting elements 3 to 6 and 39, 41, . . . , 69 that transmit essentially only tension forces. Thereby, the connecting elements 39, 41, . . . , 69 connected with the joints 109 to 112 of the third joint set are embodied as two-part divided steel cables, through which the connecting elements 40, 42, . . . , 70 are guided, whereby the connecting elements 40, 42, . . . , 70 transmit tension and compression forces and cross these steel cables.

Upon omitting the corner stands 7 to 10 and integrating the cables 39, 41, . . . , 69 forming the connecting elements that transmit essentially only tension forces into retraction and/or expansion cables, the support structure is stiffenable continuously, that is to say in every condition between the fully expanded and fully collapsed conditions, in a planar as well as in a one-fold and two-fold curved form, by a variation of the lengths of the portions of the retraction and expansion cables located in the support structure.

Figure 8:
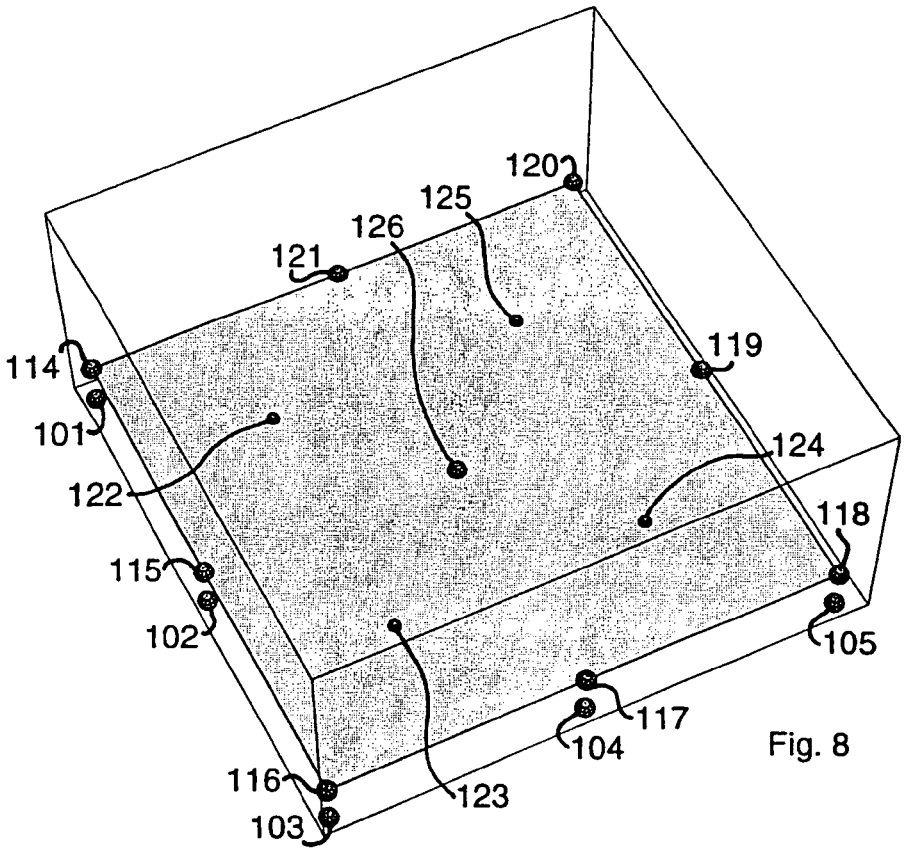
FIG. 8 shows the upper plane spanned by the joints of the first or third joint set.
Figure 9:
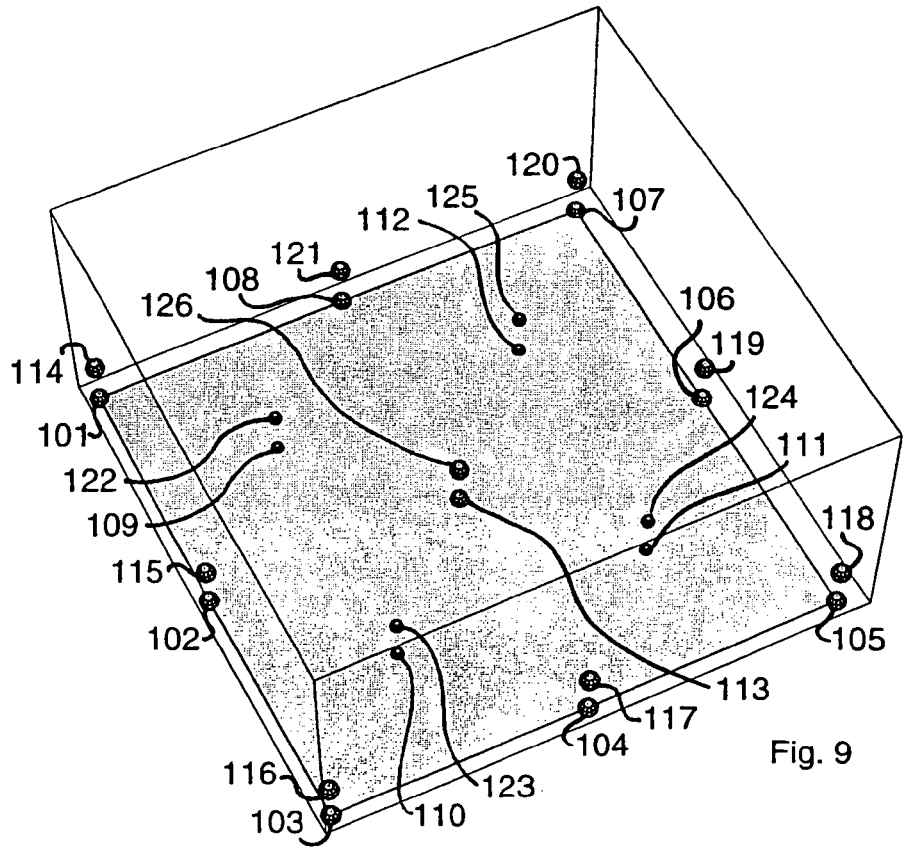
FIG. 9 shows the lower plane spanned by the joints of the second or third joint set.

The FIG. 8 shows the upper plane that is spanned by the joints 114 to 126 of the first or the third joint set, whereas the FIG. 9 shows the lower plane spanned by the joints 101 to 113 of the second or third joint set.

Figure 10:
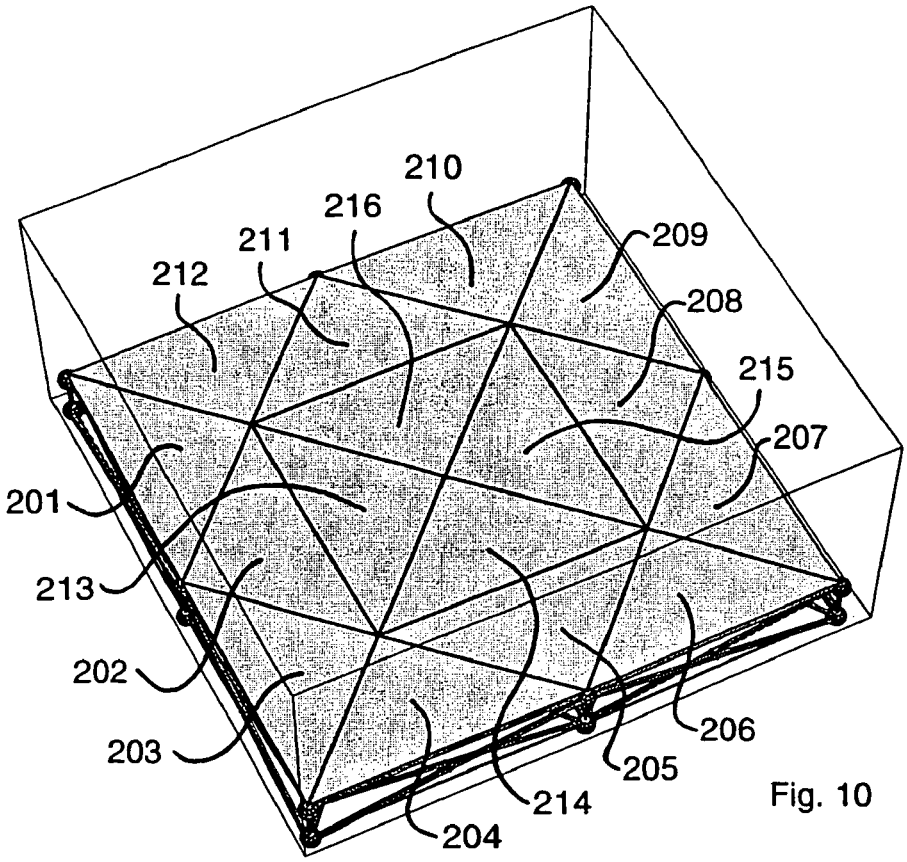
FIG. 10 shows a covering of the support structure with triangular shaped panel elements.

The FIG. 10 shows a covering of the completely expanded support structure 90 with triangular shaped panel elements 201 to 216. These respectively support themselves on three joints of the first or third joint set. The flexing of the support structure 90 caused by the mass of these panel elements can be compensated by the above described pre-stressing or over-heightening. In an advantageous manner, the panel elements 202, 205, 208, 211 and 213 to 216 respectively connect the joints 122, 123; 123, 124; 124, 125; 125, 122 of the third joint set of neighboring support structure modules 91 to 94, and especially function as further connecting elements that transmit tension and compression forces.

The FIG. 11 shows an alternative embodiment of a 2×2 arrangement of support structure modules in a support structure, which comprises a curvature in X- and Y-direction, which is made possible, among other things, by disassembly of the inner scissors arrangements and by replacement of the connecting elements 31, 33, 35, 37 which transmit tension and compression forces by the cables 31', 33', 35', 37' which transmit essentially only tension forces. Insofar as the support structure is to be curved on only one side, such a disassembly of the inner scissors arrangements is not necessary.

Figure 12:
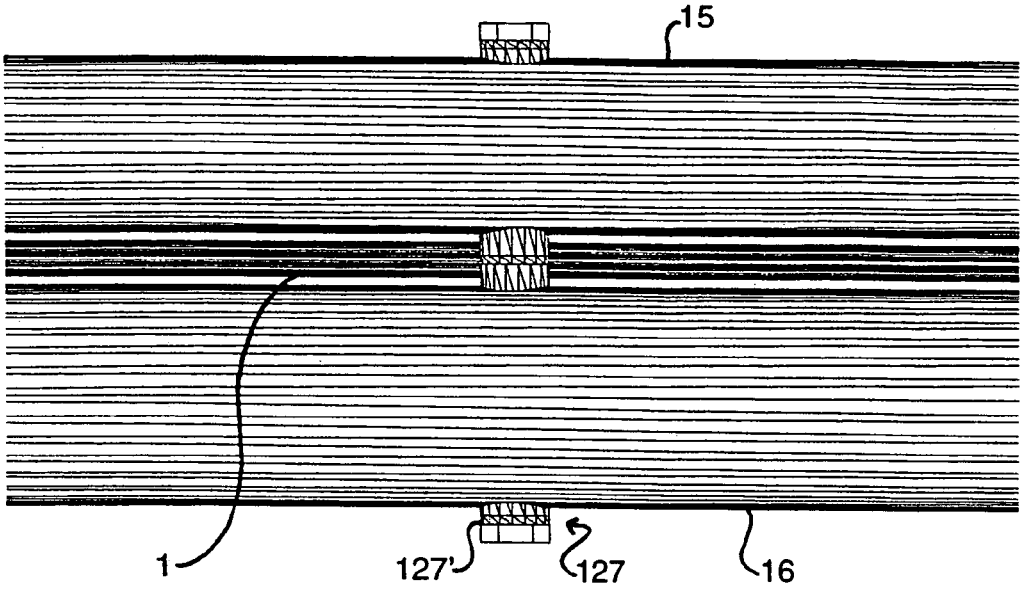
FIG. 12 shows an example of a scissors joint.

The FIG. 12 shows, as an example, a scissors joint, by which the two connecting elements 15, 16, which transmit tension and compression forces, are crossed-over and pivotally connected with one another. In this context, as can be seen in the FIG. 3, the rod 16 leads to the joint 101 on the support point of the support structure 90 and therefore comprises a larger diameter. The expansion cable 1 is guided through between the rods 15, 16. Thereby, due to the different diameters of the deflecting means arranged in the joints 101, 115, the expansion cable 1 is guided past the joint body 127' of the joint 127 or at least lies in contact thereon without a deflection force that would disadvantageously load the support structure.

Figure 13:
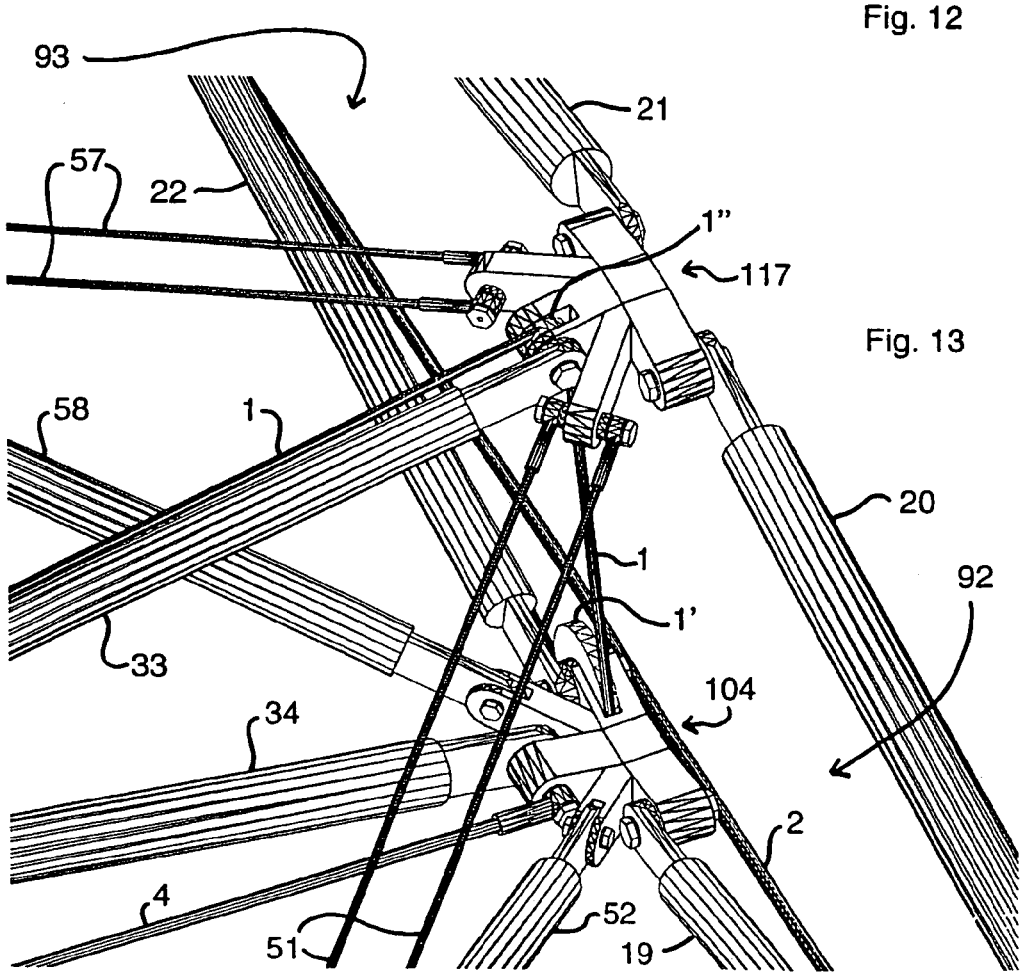
FIG. 13 shows an example of the articulated junction of the connecting elements.

The FIG. 13 shows, as an example, the articulate joining of the connecting elements on the common joints 104, 117 of the neighboring support structure modules 92, 93. The rods 19, 20; 21, 22 of the outer scissors arrangements as well as the rods 33, 34 of the inner scissors arrangement and the inner struts 42, 58 are articulately connected on the joints 104 or 117 respectively with a respective joint comprising a rotational degree of freedom. In the illustrated arrangement of rod connections, the moments introduced from the connecting elements onto the joints and horizontal force components mutually cancel each other to a great extent. The cables 51 or 57, which lead to the joints of the third joint set, are embodied in a doubled manner, and respectively receive between themselves the inner strut 52 or 58 in a crossing manner, are similarly articulately connected on the joint 117 with a rotational degree of freedom. The expansion cable 1 extends nearly parallel to the rod 22, coming from the joint 118 around the deflection roller 1' with larger diameter that is articulately connected on the joint 104, to the deflection roller 1" with smaller diameter that is articulately connected on the joint 117, and further nearly parallel to the rod 33 to the joint 113.

The invention claimed is:

1. Deployable structure with a modular configuration consisting of at least one collapsible module (91), which is bounded by joints (114, 115, 126, 121) of a first joint set, which are corner joints of the module (91) and lie in a first surface, and by joints (101, 102, 113, 108) of a second joint set, which are corner joints of the module (91) and lie in a second surface, and with at least a first joint (109, 122) of a third joint set, which first joint lies outside of the first surface and is not located at a corner of the module, whereby at least some of the joints of the first and second joint sets respectively have a constrained and fixable position relative to one another by being connected with one another by a guide mechanism comprising scissors arrangements, characterized in that:

the first joint (109) of the third joint set is connected respectively with at least two of the joints (114, 115, 113, 121) selected from at least one of the first and second joint sets by a respective tension-only connecting element (39, 41, 43, 45) that is adapted and able to transmit only tension forces, said first joint (109) of the third joint set is arranged below a lowermost joint (114, 115, 121) among the joints of the first joint set with which said first joint (109) of the third joint set is connected, forces arising upon loading of the structure by at least one of a useful working load and a self-weight load are transmittable as tension forces away from said first joint (109) of the third joint set to the joints (114, 115, 113, 121) of at least one of the first and second joint sets via the tension-only connecting element (39, 41, 43, 45) that is adapted and able to transmit only tension forces, a second joint (122) of the third joint set is connected with at least one joint (101, 102, 113, 108) of the second joint set by a connecting element (40, 42, 44, 46) that transmits tension and compression forces, and the first joint (109) of the third joint set is connected with the second joint (122) of the third joint set by a connecting element (11) that transmits compression and tension forces.

2. Structure according to claim 1, characterized in that at least one of the first surface and the second surface is a respective plane.

3. Deployable structure with a modular configuration consisting of at least one collapsible module (91), which is bounded by joints (114, 115, 126, 121) of a first joint set, which are corner joints of the module (91) and lie in a first surface, and by joints (101, 102, 113, 108) of a second joint set, which are corner joints of the module (91) and lie in a second surface, and with at least one joint (109, 122) of a third joint set, which lies outside of the first surface, whereby at least some of the joints of the first and second joint sets respectively have a fixable position relative to one another by being connectable with one another by a guide mechanism, characterized in that, one of the joints (109) of the third joint set is connected respectively with at least two of the joints (114, 115, 113, 121) selected from at least one of the first and second joint sets by a respective tension-only connecting element (39, 41, 43, 45) that is adapted and able to transmit only tension forces, and said one of the joints of the third joint set is arranged below a lowermost joint (114, 115, 121) among the joints of the first joint set with which said one of the joints of the third joint set is connected, and characterized in that forces arising upon loading of the structure by at least one of a useful working load and a self-weight load are transmittable as tension forces away from said one of the joints (109) of the third joint set to the joints (114, 115, 113, 121) of at least one of the first and second joint sets via the tension-only connecting element (39, 41, 43, 45) that is adapted and able to transmit only tension forces, and further characterized in that all of the joints (101, 102, 113, 108) of the second joint set, and said one of the joints (109) of the third joint set, which is connected with said at least two joints (114, 115, 113, 121) selected from at least one of the first and second joint sets by the tension-only connecting element (39, 41, 43, 45), lie in one plane.

4. Structure according to claim 1, characterized in that the scissors arrangements of the guide mechanism comprise guide means, and in that at least one joint (114) of the first joint set of a first corner of the module (91) arranged on an outer perimeter of the structure is connected by the guide means with a joint (102) of the second joint set of a first neighboring corner of the module (91) opposite the first corner and arranged on the outer perimeter of the structure, and a joint (101) of the second joint set of a second corner is connected by the guide means with a joint (115) of the first joint set of a second neighboring corner opposite the second corner.

5. Structure according to claim 4, characterized in that the guide means comprise connecting elements (15, 16) that transmit tension and compression forces and that are crossed-over and pivotally connected with one another.

6. Structure according to claim 5, characterized in that the connecting elements (16, 32, 17, 20, 34, 21, 24, 36, 25, 28, 38, 29) that transmit tension and compression forces and that lead to supports of the structure have a greater load capacity and a larger diameter, than remaining ones of the connecting elements (15, 31, 18, 19, 33, 22, 23, 35, 26, 27, 37, 30) of the guide means.

7. Structure according to claim 5, characterized in that at least a portion of the connecting elements (15, 16; 17, 18; up to 37, 38), which are pair-wise crossed-over and pivotally connected with one another and which transmit tension and compression forces, are connected with one another offset from their center in the longitudinal direction.

8. Structure according to claim 1, characterized in that multiple modules (91, 92, 93, 94) are arranged next to one another, and in that neighboring modules comprise common joints.

9. Structure according to claim 1, characterized in that at least some of the joints selected from at least one of the first joint set (114 to 121, 126), the second joint set (101 to 108, 113), and the third joint set (109 to 112, 122 to 125) are connectable by a membrane in such a manner so that thereby an at least partially closed outer surface of the first or second surface is formed.

10. Structure according to claim 1, characterized in that at least a portion of the joints (114 to 121, 126) of the first joint set and at least a portion of the joints (122 to 125) of the third joint set are connectable with at least one triangular panel element (201 to 216) in such a manner so that thereby an at least partially closed outer surface of the first surface is formed.

11. Structure according to claim 1, characterized in that the connecting elements that transmit tension and compression forces are articulately joined on the respective joints and are formed by rods of aluminum.

12. Deployable structure with a modular configuration consisting of at least one collapsible module (91), which is bounded by joints (114, 115, 126, 121) of a first joint set, which are corner joints of the module (91) and lie in a first surface, and by joints (101, 102, 113, 108) of a second joint set, which are corner joints of the module (91) and lie in a second surface, and with at least one joint (109, 122) of a third joint set, which joint lies outside of the first surface and is not located at a corner of the module, whereby at least some of the joints of the first and second joint sets respectively have a constrained and fixable position relative to one another by being connected with one another by a guide mechanism comprising scissors arrangements, characterized in that, one of the joints (109) of the third joint set is connected respectively with at least two of the joints (114, 115, 113, 121) selected from at least one of the first and second joint sets by a respective tension-only connecting element (39, 41, 43, 45) that is adapted and able to transmit only tension forces, and said one of the joints of the third joint set is arranged below a lowermost joint (114, 115, 121) among the joints of the first joint set with which said one of the joints of the third joint set is connected, and characterized in that forces arising upon loading of the structure by at least one of a useful working load and a self-weight load are transmittable as tension forces away from said one of the joints (109) of the third joint set to the joints (114, 115, 113, 121) of at least one of the first and second joint sets via the tension-only connecting element (39, 41, 43, 45) that is adapted and able to transmit only tension forces, and characterized in that the expansion of the module (91) or the structure (90) is adjustable by an operating arrangement.

13. Structure according to claim 12, characterized in that the operating arrangement comprises expansion and retraction mechanisms including an expansion cable and a retraction cable, which are guided in the respective joints over deflection mechanisms and are fixably operable on a common joint (101).

14. Structure according to claim 13, characterized in that the expansion cable (1) is guided in the respective joints over deflection mechanisms including deflection rollers or deflection saddles, with at least two different deflection radii.

15. Structure according to claim 13, characterized in that the structure (90) can have a pre-stress applied thereto by means of the operating arrangement, and thereby the structure (90) takes on a prescribable form in a loaded condition.

16. Deployable structure with a modular configuration consisting of at least one collapsible module (91), which is bounded by joints (114, 115, 126, 121) of a first joint set, which are corner joints of the module (91) and lie in a first surface, and by joints (101, 102, 113, 108) of a second joint set, which are corner joints of the module (91) and lie in a second surface, and with at least one joint (109, 122) of a third joint set, which lies outside of the first surface, whereby at least some of the joints of the first and second joint sets respectively have a fixable position relative to one another by being connectable with one another by a guide mechanism, characterized in that, one of the joints (109) of the third joint set is connected respectively with at least two of the joints (114, 115, 113, 121) selected from at least one of the first and second joint sets by a respective tension-only connecting element (39, 41, 43, 45) that is adapted and able to transmit only tension forces, and said one of the joints of the third joint set is arranged below a lowermost joint (114, 115, 121) among the joints of the first joint set with which said one of the joints of the third joint set is connected, and characterized in that forces arising upon loading of the structure by at least one of a useful working load and a self-weight load are transmittable as tension forces away from said one of the joints (109) of the third joint set to the joints (114, 115, 113, 121) of at least one of the first and second joint sets via the tension-only connecting element (39, 41, 43, 45) that is adapted and able to transmit only tension forces, and further characterized in that the tension-only connecting elements that are adapted and able to transmit only tension forces are attached by being articulately joined on the respective joints, and at least partially are formed by respectively two parallel extending wires or cables of steel.

17. Deployable structure with a modular configuration consisting of at least one collapsible module (91), which is bounded by joints (114, 115, 126, 121) of a first joint set, which are corner joints of the module (91) and lie in a first surface, and by joints (101, 102, 113, 108) of a second joint set, which are corner joints of the module (91) and lie in a second surface, and with at least one joint (109, 122) of a third joint set, which joint lies outside of the first surface and is not located at a corner of the module, whereby at least some of the joints of the first and second joint sets respectively have a constrained and fixable position relative to one another by being connected with one another by a guide mechanism comprising scissors arrangements, characterized in that, one of the joints (109) of the third joint set is connected respectively with at least two of the joints (114, 115, 113, 121) selected from at least one of the first and second joint sets by a respective tension-only connecting element (39, 41, 43, 45) that is adapted and able to transmit only tension forces, and said one of the joints of the third joint set is arranged below a lowermost joint (114, 115, 121) among the joints of the first joint set with which said one of the joints of the third joint set is connected, and characterized in that forces arising upon loading of the structure by at least one of a useful working load and a self-weight load are transmittable as tension forces away from said one of the joints (109) of the third joint set to the joints (114, 115, 113, 121) of at least one of the first and second joint sets via the tension-only connecting element (39, 41, 43, 45) that is adapted and able to transmit only tension forces, wherein each said tension-only connecting element comprises at least one wire or cable that is adapted and able to transmit only tension forces.

* * * * *